US007284342B2

(12) United States Patent
Avent et al.

(10) Patent No.: US 7,284,342 B2
(45) Date of Patent: Oct. 23, 2007

(54) HEEL INSERT

(75) Inventors: Richard T Avent, Memphis, TN (US); Philip C. Yang, Memphis, TN (US); Donald G. Moore, Memphis, TN (US); Harold A. Howlett, Nesbit, MS (US); Laura Crane, Williston, TN (US)

(73) Assignee: Schering-Plough HealthCare Products, Inc., Memphis, TN (US)

( * ) Notice: Subject to any disclaimer, the term of this patent is extended or adjusted under 35 U.S.C. 154(b) by 463 days.

(21) Appl. No.: 10/912,804

(22) Filed: Aug. 6, 2004

(65) Prior Publication Data

US 2006/0026866 A1 Feb. 9, 2006

(51) Int. Cl.
*A43B 13/38* (2006.01)

(52) U.S. Cl. ..... 36/44; 36/28; 36/30 R

(58) Field of Classification Search ..... 36/44, 36/43, 28, 30 R
See application file for complete search history.

(56) References Cited

U.S. PATENT DOCUMENTS 4,627,179 A * 12/1986 McElroy ..... 36/44
4,910,886 A * 3/1990 Sullivan et al. ..... 36/44
6,286,232 B1 * 9/2001 Snyder et al. ..... 36/43
6,481,120 B1 * 11/2002 Xia et al. ..... 36/44
2002/0050080 A1 * 5/2002 Vasyli ..... 36/145
2004/0025376 A1 * 2/2004 Grisoni et al. ..... 36/44
2006/0026866 A1 * 2/2006 Avent et al. ..... 36/44

FOREIGN PATENT DOCUMENTS

EP 1623642 A1 * 2/2006

* cited by examiner

*Primary Examiner*—Ted Kavanaugh
(74) *Attorney, Agent, or Firm*—Matthew J. Golden

(57) ABSTRACT

A removable insole for insertion into footwear, includes a forefoot portion, a heel portion, and an arch portion connecting together the forefoot and heel portions. At least one of the forefoot portion, heel portion and arch portion is formed by a lower layer of a resilient material which provides a cushioning function, and an upper layer positioned and secured on top of the lower layer and formed of a material having a Shore "000" hardness of less than about 45, and a tear strength greater than about 6.3 lb/in.

24 Claims, 11 Drawing Sheets

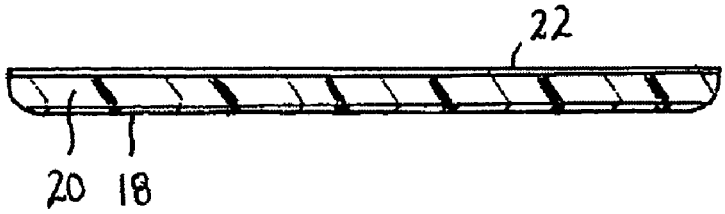
FIG. 7
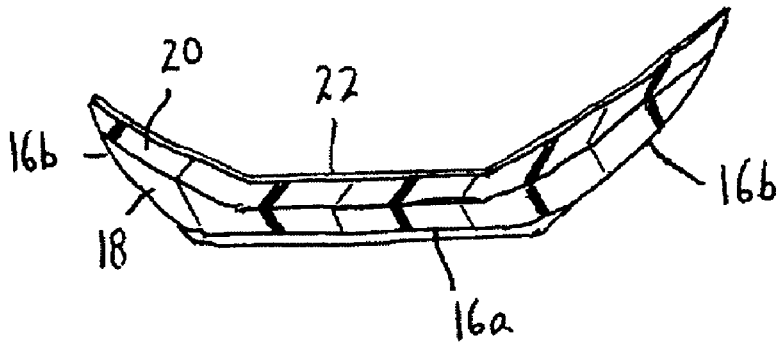
FIG. 8
FIG. 9
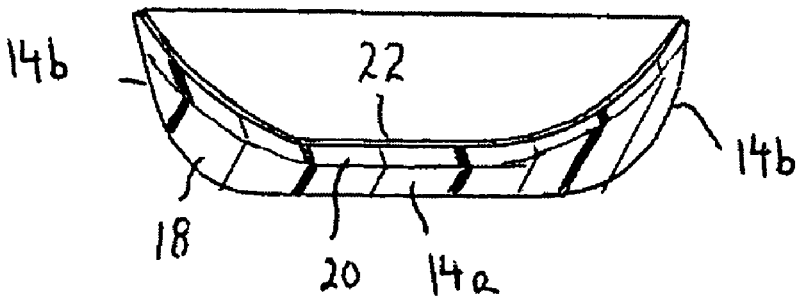

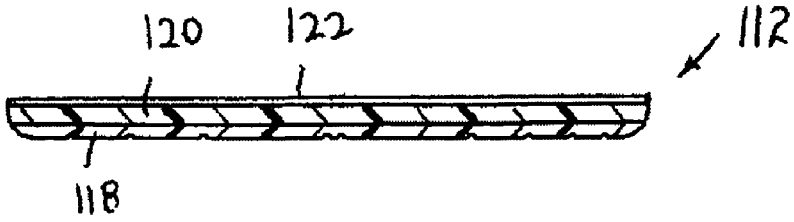
FIG. 13
FIG. 14
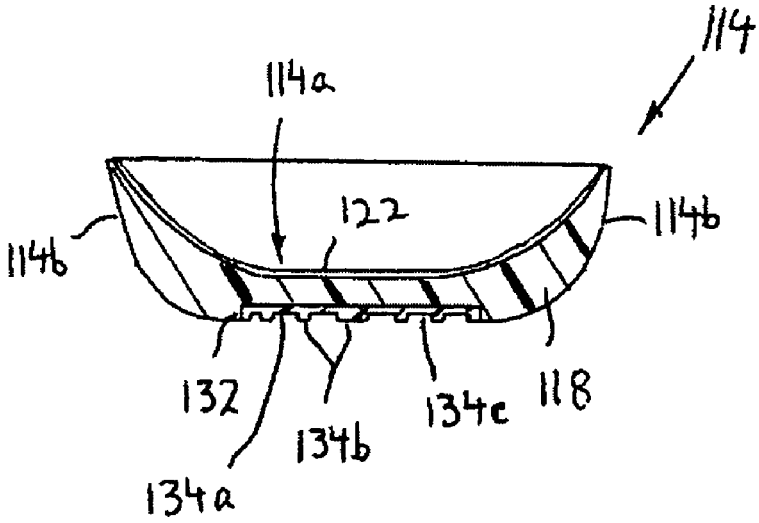

HEEL INSERT

BACKGROUND OF THE INVENTION

The present invention relates generally to shoe insoles, and more particularly, to insoles particularly adapted to provide improved proprioception.

The assignee of the present application presently sells insoles under the trademarks "STEPWELL" which molds to the bottom of the foot to relieve high-pressure points and promote healthier foot circulation.

Specifically, these insoles, which are described in applicant's U.S. Pat. No. 6,481,120, the entire disclosure of which is incorporated herein by reference, includes a forefoot portion formed by dual layers of the same outer dimensions and of the same thickness. The dual layers of the forefoot portion are made from different polyurethane foam materials, having different characteristics. Specifically, the bottom layer is made from a resilient foam material that provides a conventional cushioning function. In effect, the bottom layer is a typical foam mechanical spring, shock absorption layer that cushions the foot, in order to decrease pressure in any area of the forefoot. On the other hand, the top layer is made from a slow recovery foam material that has a conforming property. Thus, the top layer temporarily collapses under pressure, and absorbs the shear, that is, dampens the same, and accommodates the shape of the foot. If there are bony protuberances, the top layer absorbs and redistributes the forces. The top layer thereby sculptures to the pressure points and spreads the pressure out along the entire forefoot portion. Thus, by tuning the different layers of the forefoot portion, the forefoot portion optimally accommodates the deformation of the forefoot region of the foot, and reduces foot plantar pressure.

The basis for this construction is that arthritic people commonly experience forefoot pain and swelling in the metatarsal area. This results from a remodeling of the foot, that is, a structural change in the forefoot. Specifically, depressed or prominent metatarsal heads are formed, which result in bony protuberances, and thereby pressure points, at the bottom of the foot, which can be very painful. This causes impaired ambulatory ability and gait. Further, deformation of foot joints in arthritic people can produce excessive plantar pressure, which will worsen the pain and discomfort in the foot. Arthritic people also experience mid-foot/arch problems. By using the two layers, there is a cushioning effect from the lower layer and a pressure redistribution effect from the upper layer, in order to alleviate these problems.

These insoles also include a contoured construction in the medial arch area. The medial arch portion is built up in height and provides spaced apart, transverse oriented grooves or recesses therein, which define transverse flex members between the recesses, the flex members effectively functioning as springs. The flex members function to provide even cushioning support and shock absorption over the entire mid-foot area during mid-stance phase.

Although this construction functions to reduce lower extremity, back and foot pain by optimally accommodating deformation of the forefoot region and reducing foot plantar pressure in the forefoot region, it does not customize in shape to the person's foot to provide maximum proprioception.

SUMMARY OF THE INVENTION

Accordingly, it is an object of the present invention to provide an insole that overcomes the problems with the aforementioned prior art.

It is another object of the present invention to provide an insole adapted to provide improved proprioception (maximum comfort to the wearer), while also providing high tear strength of the foam material.

It is yet another object of the present invention to provide an insole capable of customizing to the individual anatomical plantar features during gaiting.

It is a further object of the present invention to provide an insole having an arch which is contoured at the upper and lower surfaces thereof.

It is a yet further object of the present invention to provide an insole that is easy and economical to make and use.

In accordance with an aspect of the present invention, a removable insole for insertion into footwear, comprises at least one of a forefoot portion, a heel portion, and an arch portion; and at least one of the forefoot portion, heel portion and arch portion being formed by a lower layer of a resilient material which provides a cushioning function, and an upper layer positioned and secured on top of the lower layer and formed of a material having a Shore "000" hardness of less than about 45, and a tear strength greater than about 6.3 lb/in.

In one embodiment, the insole is a full length insole formed from the forefoot portion, heel portion and arch portion connecting together the forefoot portion and the heel portion. In such case, the upper layer can extend along an entire length of the insole in the forefoot portion in which the lower layer and upper layer have the same dimensions and shapes, and the upper layer is superposed on the lower layer, heel portion and arch portion, or can extend substantially only along the forefoot portion. A top cover is secured to an upper surface of the upper layer.

Preferably, the lower layer has a greater thickness than the upper layer at the heel portion, and the upper layer has a greater thickness than the lower layer at the forefoot portion.

The heel portion is cupped so as to be formed by a relatively flat central portion and a sloped side wall. Thus, the sloped side wall extends around a periphery of the heel portion and forwardly to at least the arch portion of the insole.

Preferably, the upper and lower layers are both formed from polyurethane materials, and the upper layer has a Shore A000" hardness of about 30.

In addition, the insole includes at least the arch portion, and further comprising a rigidifying material secured between the upper and lower layers for increasing rigidity of the lower layer during manufacturing of the insole in order to retain a lower surface of the arch portion in an arched configuration. Preferably, the rigidifying material includes a non-woven fabric. As a result, the lower surface of the arch portion is raised up to conform to an arch of a person's foot.

In accordance with another aspect of the present invention, footwear comprises an outer sole; an inner sole connected to the outer sole and including a forefoot portion extending at least to metatarsals of a foot, a heel portion, and a mid-foot portion connecting together the forefoot portion and the heel portion, the mid-foot portion including a medial arch portion; and an upper connected to at least one of the outer sole and the inner sole. At least one of the forefoot portion, heel portion and mid-foot portion is formed by a lower layer of a resilient material which provides a cushioning function, and an upper layer positioned and secured on top of the lower layer and formed of a material having a Shore "000" hardness of less than about 45, and a tear strength greater than about 6.3 lb/in.

The above and other features of the invention will become readily apparent from the following detailed description thereof which is to be read in connection with the accompanying drawings.

BRIEF DESCRIPTION OF THE DRAWINGS

FIG. 7 is a transverse cross-sectional view of the forefoot portion of the left insole, taken along line 7-7 of FIG. 2;

FIG. 8 is a transverse cross-sectional view of the arch portion of the left insole, taken along line 8-8 of FIG. 2; and FIG. 9 is a transverse cross-sectional view of the heel portion of the left insole, taken along line 9-9 of FIG. 2;

FIG. 13 is a transverse cross-sectional view of the forefoot portion of the left insole, taken along line 13-13 of FIG. 10; and FIG. 14 is a transverse cross-sectional view of the arch portion of the left insole, taken along line 14-14 of FIG. 10.

DETAILED DESCRIPTION

Figure 1:
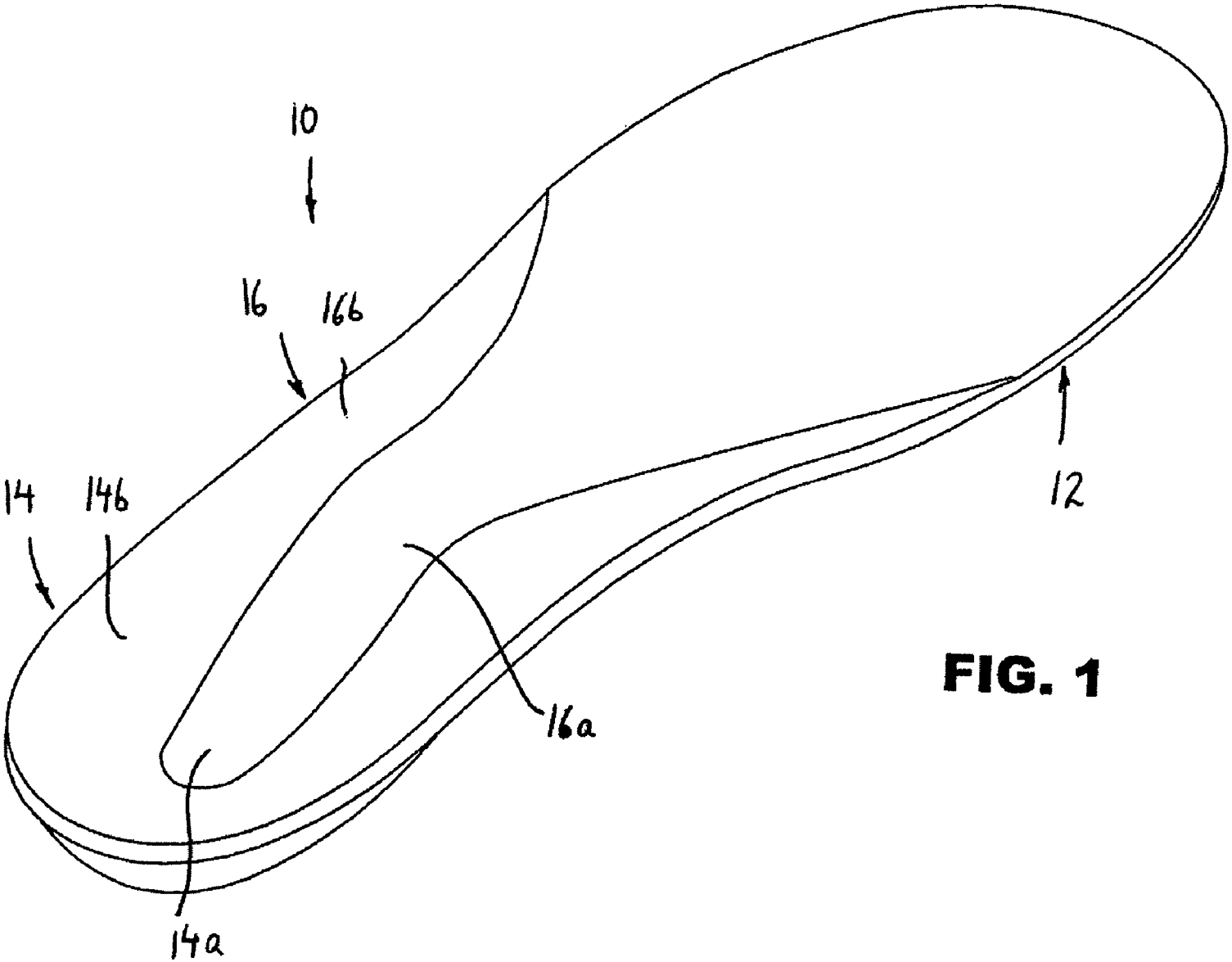
FIG. 1 is a perspective view of a left insole according to a first embodiment of the present invention.
Figure 2:
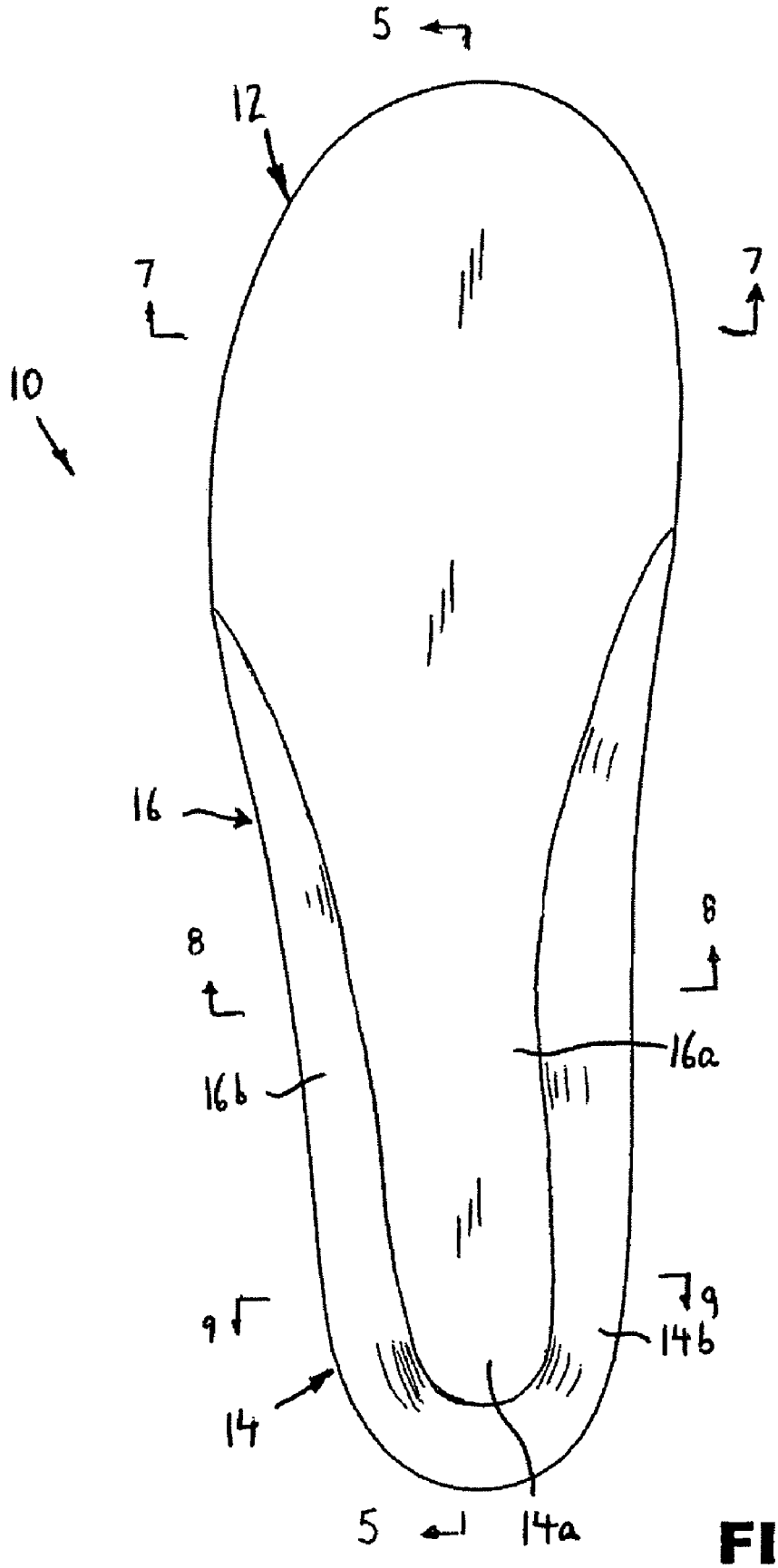
FIG. 2 is a top plan view of the left insole.

Referring to the drawings in detail, a left insole 10 according to a first embodiment of the present invention is adapted to be placed in an article of footwear, as is well known. A right insole (not shown) is identical to left insole 10 and is a mirror image thereof.

Insole 10 has the shape of a human left foot and therefore includes a curved toe or forefoot portion 12, a heel portion 14, and a mid-foot portion 16 which connects forefoot portion 12 and heel portion 14 together. Heel portion 14 has a greater thickness than forefoot portion 12. For example, heel portion 14 may have a thickness of about 0.32 inch, while forefoot portion 12 may have a thickness of about 0.16 inch.

Insole 10 is formed by a lower cushioning layer 18, an upper foam layer 20 and a top cover 22 secured to the upper surface of upper foam layer 20, along forefoot portion 12, cupped heel portion 14 and mid-foot portion 16, by any suitable means, such as adhesive, RF welding, etc.

In accordance with an important aspect of the present invention, dual layers 18 and 20 are made from different materials, preferably polyurethane foam, having different characteristics. Specifically, lower layer 18 is made from a resilient foam material that provides a conventional cushioning function. In effect, lower layer 18 is a typical foam mechanical spring, shock absorption layer that cushions the foot, in order to decrease pressure in any area of the forefoot.

Cushioning lower layer 18 can be made from any suitable material including, but not limited to, any flexible material which can cushion and absorb the shock from heel strike on the insole. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees C. to 100 degrees C. may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymerXAS 10971.02 and polyol blend XUS 18021.00 available from the Dow Chemical Company, Midland, Mich.; and Niax 34-28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1 (CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers).

Preferably, cushioning lower layer 18 is made from a urethane molded material, and more preferably, a polyurethane elastomer material, with a Shore "00" durometer hardness in the range of approximately 40-55. This provides good cushioning for the foot. The lower durometer range as compared to conventional insoles, provides appropriate cushioning for the lower pressure loading associated with fitness walking, as compared to the higher pressure loading associated with running. The foam material also resists significant compression set, thereby maintaining sufficient cushioning throughout the life of the insert.

The materials of lower layer 18 can be prepared by conventional methods such as heat sealing, ultrasonic sealing, radio-frequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530,489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. For example, the innersole can be prepared by a foam reaction molding process such as taught in U.S. Pat. No. 4,694,589.

In accordance with an important aspect of the present invention, upper layer 20 is a slow response foam material, but is different from that of U.S. Pat. No. 6,481,120, since the slow response foam material does not recover within the range recited in U.S. Pat. No. 6,481,120. Specifically, in U.S. Pat. No. 6,481,120, the slow recovery material of the second layer therein has a degree of recovery in the range of 35 percent to 70 percent after a load has been removed for 0.5 seconds.

Since the goal of the present invention is to provide a perfect contact image of the bottom of the person's foot, the material of upper layer 20 has a response time of recovery slower than that of U.S. Pat. No. 6,481,120. As a result, the total insole sculpts to the bottom of the person's foot. The purpose is to perceptually make the person feel better. Specifically, this provides a maximum proprioception response, which is the surface sensation of the nerve endings in the person's body, providing a perception of maximum comfort to the wearer. In a sense, the present invention provides maximum sensory cushioning response.

The very soft and cushioning upper foam layer 20 is thereby capable of conforming to the shape of the plantar surface of a person's foot during gaiting or by stepping thereon. Preferably, upper foam layer 20 has a Shore A000" hardness of 30. Shore A000" is the hardness scale used to quantify soft foam. The foam material also has a unique rebound rate such that the imprint of the plantar surface can be clearly seen during the rebound phase upon recovery from compression. Therefore, the present invention provides an insole that is capable of customizing to the individual anatomical plantar features during gaiting by virtue of the soft and the unique rebound behaviors of upper layer 20.

Preferably, upper foam layer 20 is one sold by Rubberlite, Inc. of Huntington, W. Va., under the designation VB2. This material is a soft, low density foam material having a density of 6 lb. per cubic foot and a high tear strength of 7.4 lb/in. The high tear strength is particularly required at the edge of the wall of the heel cupping portion 14 where upper layer 20 is exposed without much protection. In this regard, upper foam layer 20 is a low density foam material, while having a high tear strength.

In contrast, other resilient grade foam materials 9215, 9415 and 9612 sold by Rogers Corporation of Rogers, Conn. under the trademark "PORON" have higher densities and lower tear strengths, as follows:

TABLE I

| Foam Material | Shore A000" Hardness | Tear Strength (lb/in) | Recovery Time (sec) | Density (lb/ft$^3$) |
|---|---|---|---|---|
| 9215 | 40 | 5.2 | 0.97 | 15 |
| 9415 | 53 | 7.1 | 0.92 | 15 |
| 9612 | 55 | 12.8 | — | 12 |
| VB2 | 30 | 7.4 | 1.27 | 6 |

Tests were performed with insoles in which the upper layer 20 was made with a PORON 9215 foam material and insoles in which the upper layer 20 was made with a VB2 foam material, since PORON 9215 foam material is the closest to the VB2 foam material as to softness, as determined by the Shore A000" hardness, in order to provide improved proprioception. It was determined that the VB2 foam material as a upper layer 20 had a much better resistance to foam splitting than insoles made with the PORON 9215 foam material. Specifically, this was evidenced by a one week wear study of insoles of the above construction of 33 male subjects (66 insoles) and 31 female subjects (62 insoles) in which the upper layer 20 was made with the two different foam materials:

TABLE II

| Top Foam Layer | Men (Damaged) | Women (Damaged) |
|---|---|---|
| VB2 | 0 | 0 |
| PORON 9215 | 6 | 1 |

Thus, with the Rogers PORON 9612, 9415 and 9215 foam materials, as the softness measured by the Shore "000" hardness test decreases, the tear strength also decreases. Thus, for example, while the PORON 9215 cited in U.S. Pat. No. 6,481,120 has a desired softness, the tear strength dropped to a level that caused the prototypes according to Table II to have high damage counts. The use of the VB2 foam material provided a sufficiently soft material with a lower Shore hardness "000" and a lower foam density, while providing a high tear strength, which as indicated in Table II above, provided no damaged prototype insoles.

In like manner, although the PORON 9612 and 9415 foam materials have an acceptable tear strength, they both have high Shore "000" hardness readings, and are therefore unacceptable.

Therefore, in accordance with the present invention, it is important that upper foam layer 20 have a Shore "000" hardness reading of less than about 45, and a tear strength greater than about 6.3 lb/in.

The recovery time indicated in the tables above, is measured as follows. A nominal one-half inch height foam with one square inch cross-sectional area is compressed to 35% of its height in about 1.2 second. The compression of the foam is achieved by moving the cross head of the testing instrument, which is manufactured by Instron Corporation of Canton, Mass., downward at a rate of 20 in/min. Immediately after reaching 65% of compression, the cross head is then traversed upward at a rate of 20 in/min, and returned to a position equal to 12% of the foam compression. This down stroke/up stroke cycle mimics the compression and recovery behavior of the foam during gaiting. As the cross head is moved in the down stroke motion, the load signal will reach the maximum value just before the cross head reverses into the upward stroke motion. As the cross head traverses upward, the load signal in the Instron machine will drop precipitously until the foam material substantially recovers to 88% of its original height. The time of the foam recovery is then defined as the difference between the time when the foam material reaches its maximum compression load and the time when the load signal no longer decreases. The reason that the load does not decrease further is due to the sensing of the upward pushing of the recovered foam material by the load cell which stands still at the end of the upward stroke. In a way, the load cell is waiting to detect the recovery of the compressed foam material. The recovery time is also discussed in detail in U.S. Pat. No. 6,481,120, the entire disclosure of which is incorporated herein by reference.

As shown in FIGS. 4-7, although not required, the height or thickness of upper layer 20 is substantially constant throughout the length of insole 10, for example, equal to about 3.4 mm. On the other hand, the height or thickness of lower layer 18 decreases from heel portion 14 to forefoot portion, for example, from a thickness of about 0.7 cm at heel portion 14 to a thickness of about 0.1 cm at forefoot portion 12. Thus, the thickness of upper layer 20 is preferably less than that of lower layer 18 at heel portion 14, while gradually increasing to a thickness greater than that of lower layer 18 at forefoot portion 12. This is because there is greater proprioception at the forefoot portion 12 where the person can feel the difference than at heel portion 14, and for this reason, upper layer 20 is thicker. At heel portion 14, where there is less proprioception and where there is a greater impact during a gait, heel portion 14 preferably requires a larger cushioning. For this reason, lower layer 18 is thicker at heel portion 14. The center of the arch may be raised to such an extent to provide the contoured shape of the insole. The arch height, as defined by the height of the empty space under the arch, is about 8 mm for men's insoles and 7 mm for women's insoles.

Preferably, dual layers 18 and 20 are superimposed in exact alignment with one another, and thereby have the same shape and outer dimensions. This is particularly true for men's insoles which take more wear. In women's insoles, however, where wear is not as extreme, lower layer 18 can terminate in forefoot portion 12 just short of the metatarsal region, as shown by dashed line 24 in FIG. 3. Specifically, lower layer 18 extends for a length of about three-fourths the length of insole 10, measured from the rear edge at heel portion 14. In this case, since the lower surface of lower layer 18 is exposed at forefoot portion 12, this lower surface is preferably covered by a very thin film (not shown) of thermoplastic urethane (TPU) material to enhance the aesthetic appearance of the lower surface of lower layer 18 and to enhance the abrasion resistance of the same, since the foam cell structure of lower layer 18 is preferably porous.

With the above construction, resilient upper layer 20 provides cushioning and also imparts a three-dimensional shape of the insole. However, resilient upper layer 20 is a cushioning foam with low rigidity. Therefore, the curvature of the arch 26 at mid-foot portion 16 tends to be flattened out during manufacture of insole 10. In order to maintain the desired contoured height in the arch area, a very thin, non-woven fabric 28 (FIG. 3) is provided in mid-foot portion 16, extending partially into heel portion 14, to reinforce the rigidity of the foam in the arch area. Non-woven fabric 28 is positioned in the mold during formation of resilient lower layer 18 during the foam casting or molding process and forms part of the arch structure, increasing the local rigidity of the foam material at arch 26. Specifically, non-woven fabric 28 is positioned in the mold, and then lower layer 18 is molded therein such that non-woven fabric 28 is fixed to the upper surface of lower layer 18. Then, when lower layer 18 is removed from the mold, lower layer 18 will retain its arch shape at the lower surface thereof. Thereafter, upper layer 20, with top cover 22 already secured thereon, is adhesively fixed to lower layer 18, whereby non-woven fabric 28 is sandwiched between soft customizing upper layer 20 and resilient cushioning lower layer 18 to provide the contoured construction of insole 10. Non-woven fabric 28 can be made of any suitable material, such as polyester, polypropylene, cotton, a polyester cotton blend, etc., but is preferably made from polyester.

Figure 4:
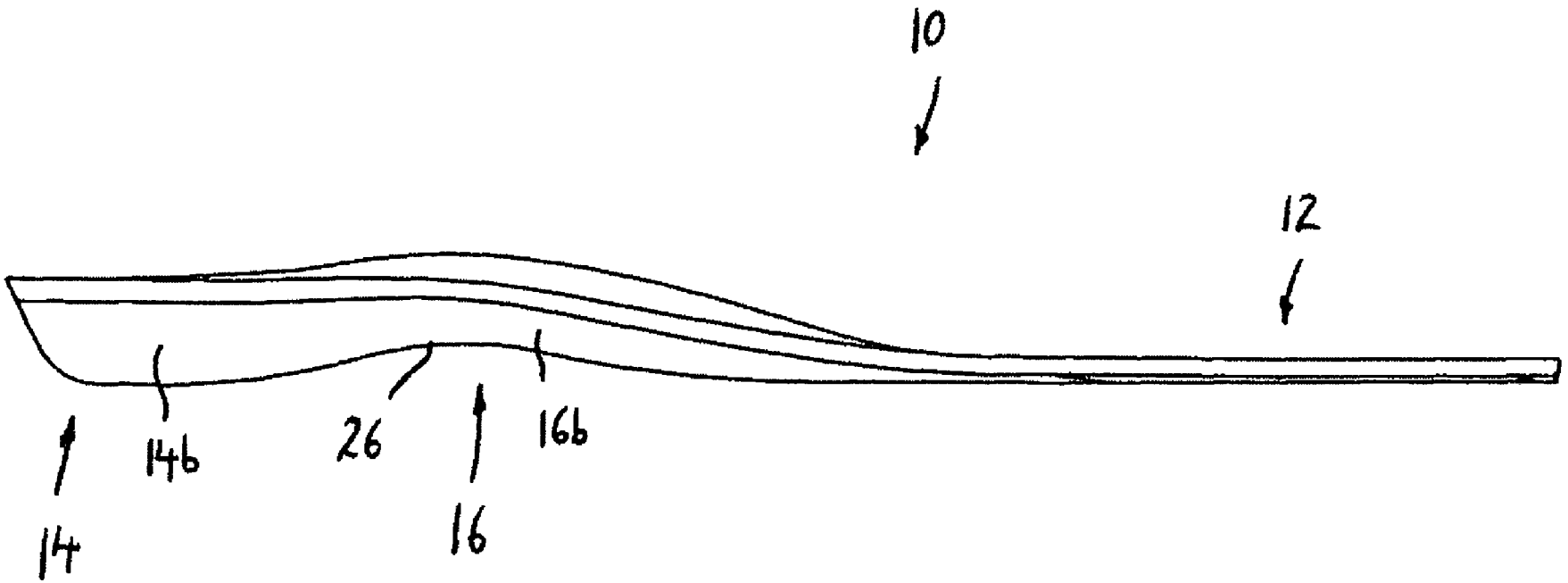
FIG. 4 is a right side elevational view of the left insole.
Figure 5:
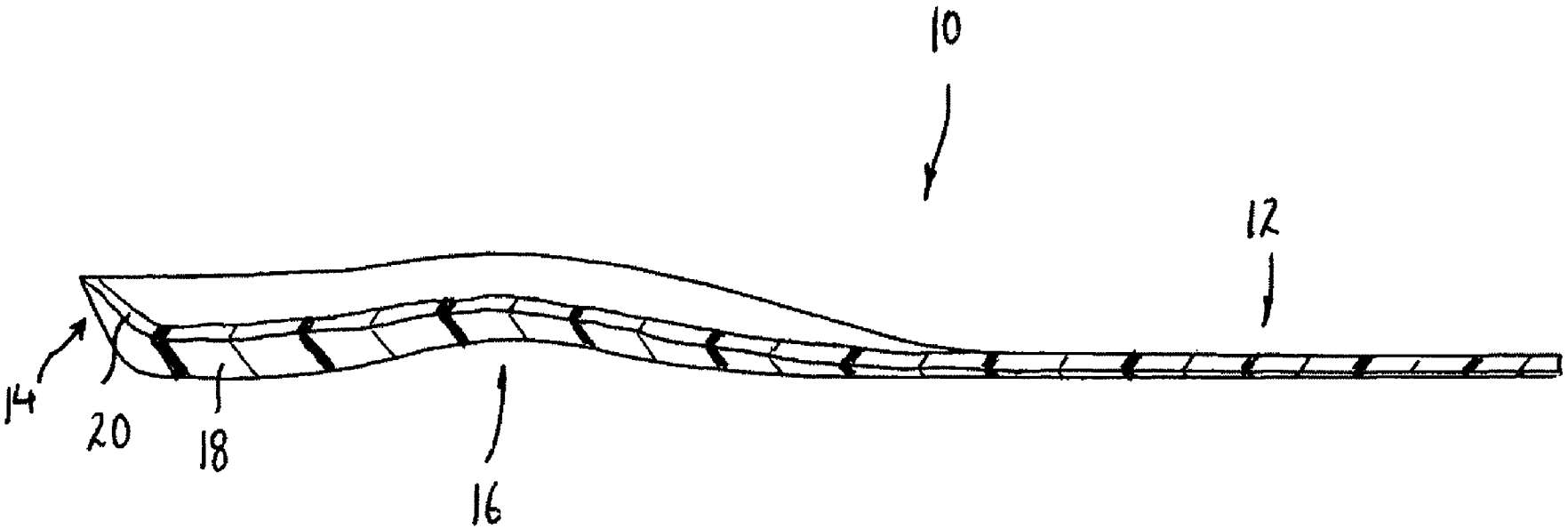
FIG. 5 is a longitudinal cross-sectional view of the left insole, taken along line 5-5 of FIG. 2.
Figure 6:
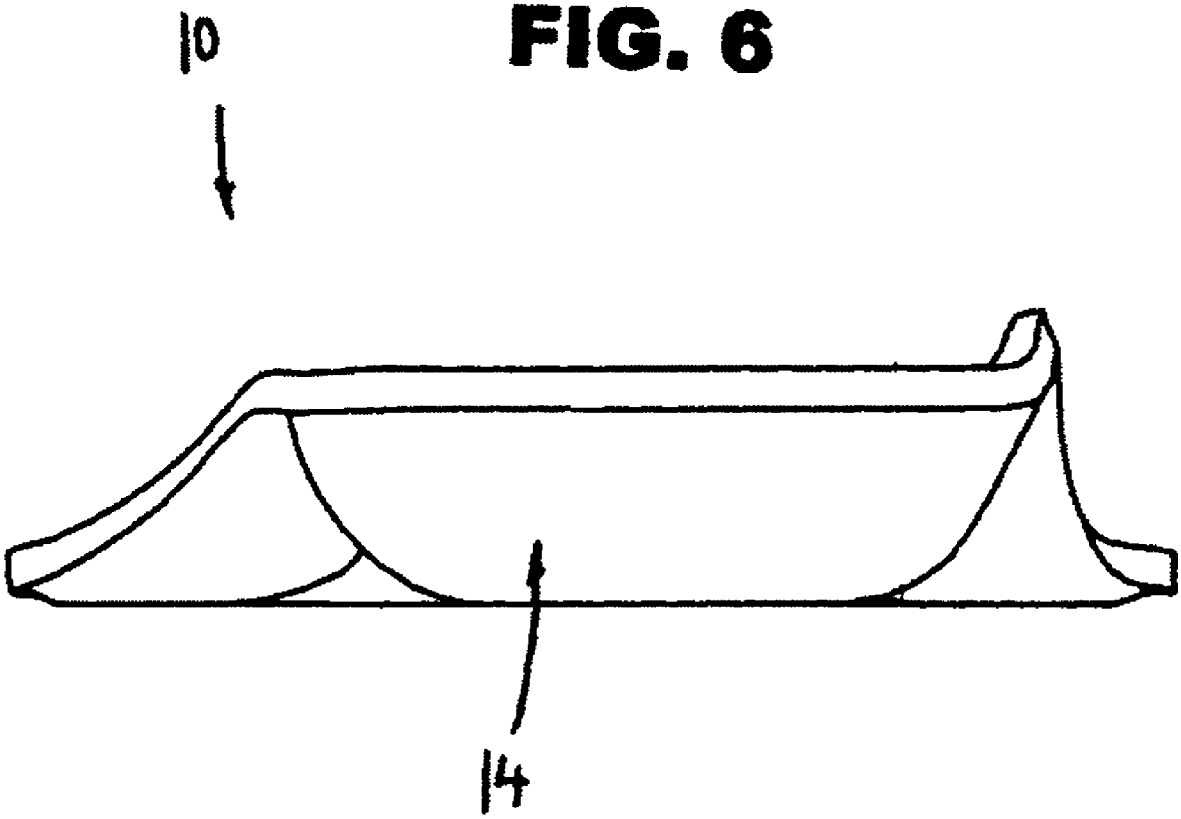
FIG. 6 is an enlarged rear elevational view of the left insole.
Figure 10:
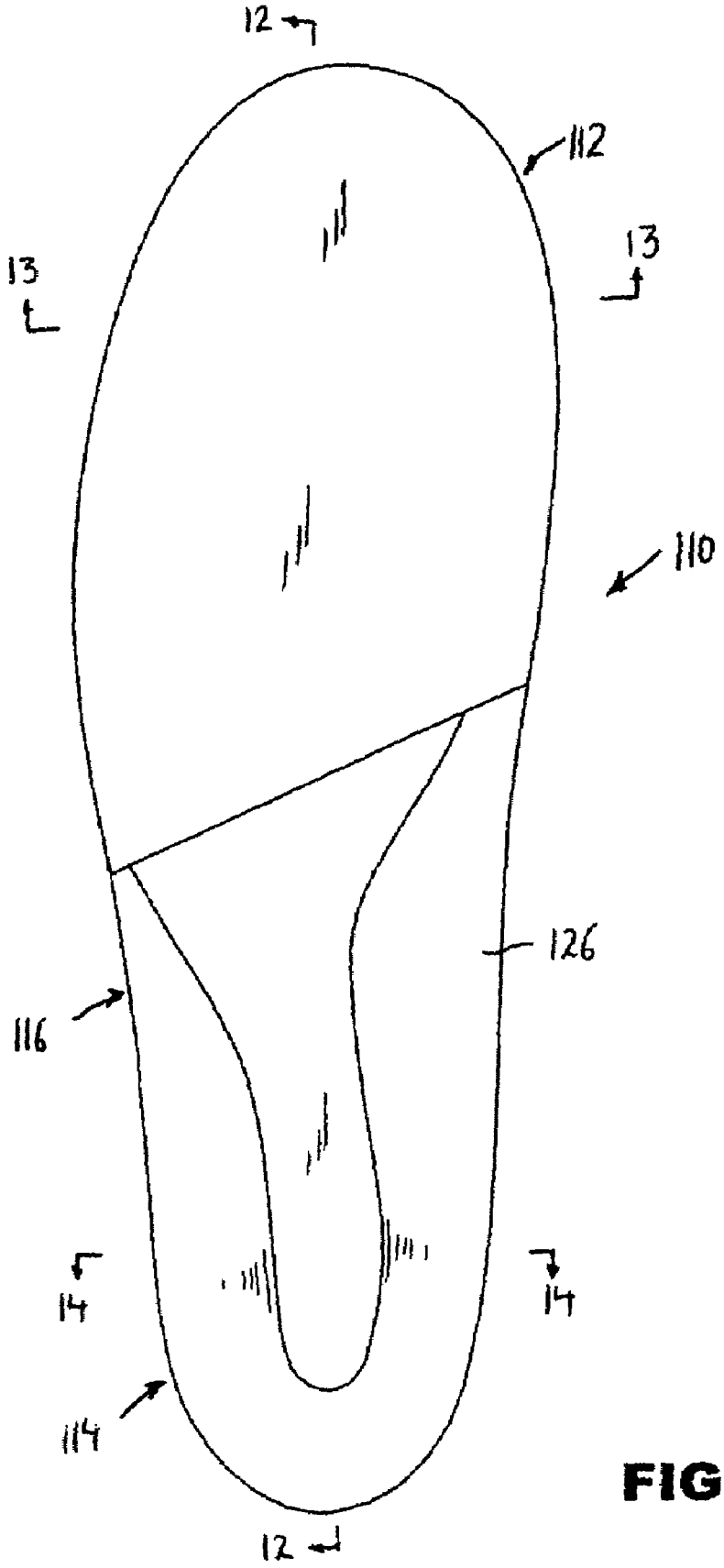
FIG. 10 is a top plan view of a left insole according to a second embodiment of the present invention.
Figure 11:
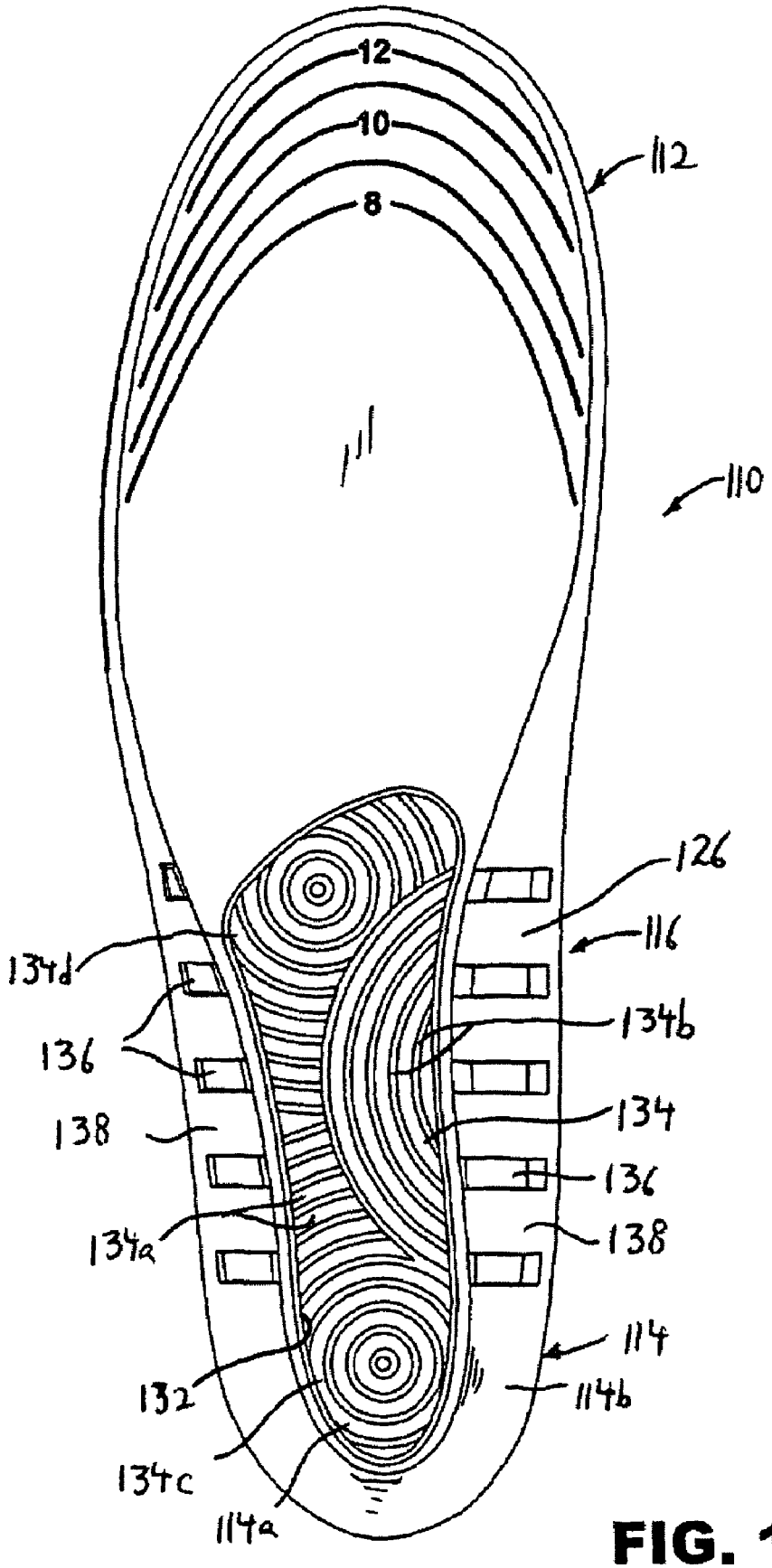
FIG. 11 is a bottom plan view of the left insole of FIG. 10.
Figure 12:
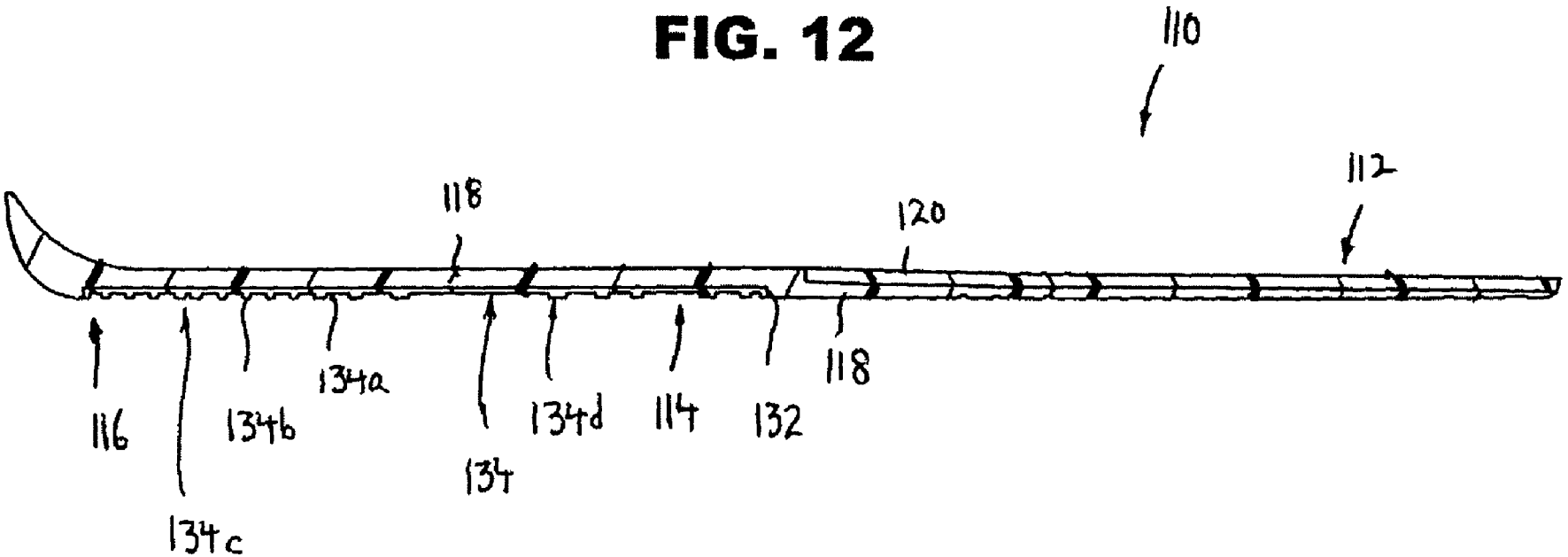
FIG. 12 is a longitudinal cross-sectional view of the left insole of FIG. 10, taken along line 12-12 thereof.

Thus, in addition to maximum proprioception response, insole 10 provides an arch contour at mid-foot portion 16. Specifically, arch 26 at mid-foot portion 16 is raised in an arch shape in the lengthwise direction at the lower surface 16*c* of insole 10, as shown in FIGS. 4 and 5. This is different from conventional insoles which provide that the arch is flat at the lower surface to conform to the shoe and is then raised or built up from the flat lower surface to conform to the person's arch. With the present invention, arch 26 is preferably raised up along the lower surface of insole 10 and also conforms to the person's foot. In other words, the lower surface of arch 26 is contoured to the person's foot and not to the shoe. This is due to the structure and material that is used.

The contour or shape of arch 26 is specified by the height of the cavity under arch 26. The height is defined as the largest distance from a flat surface to the lower surface of the arch 26. Preferably, this height is in the range of 6 mm to 12 mm for men's insoles, with a most preferred value of 9 mm, and within the range of 4 mm to 10 mm for women's insoles, with a most preferred value of 7 mm.

Top cover 22 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover 22 include good durability, stability and visual appearance. It is also desirable that top cover 22 have good flexibility, as indicated by a low modulus, in order to be easily moldable. The bonding surface of top cover 22 should provide an appropriate texture in order to achieve a suitable mechanical bond to the upper surface of upper layer 20. Preferably, the material of top cover 22 is a fabric, such as a brushed knit laminate top cloth (brushed knit fabric/urethane film/non-woven scrim cloth laminate) or a urethane knit laminate top cloth. Preferably, top cover 22 is made from a polyester fabric material, and preferably has a thickness of about 0.02 inch.

Figure 3:
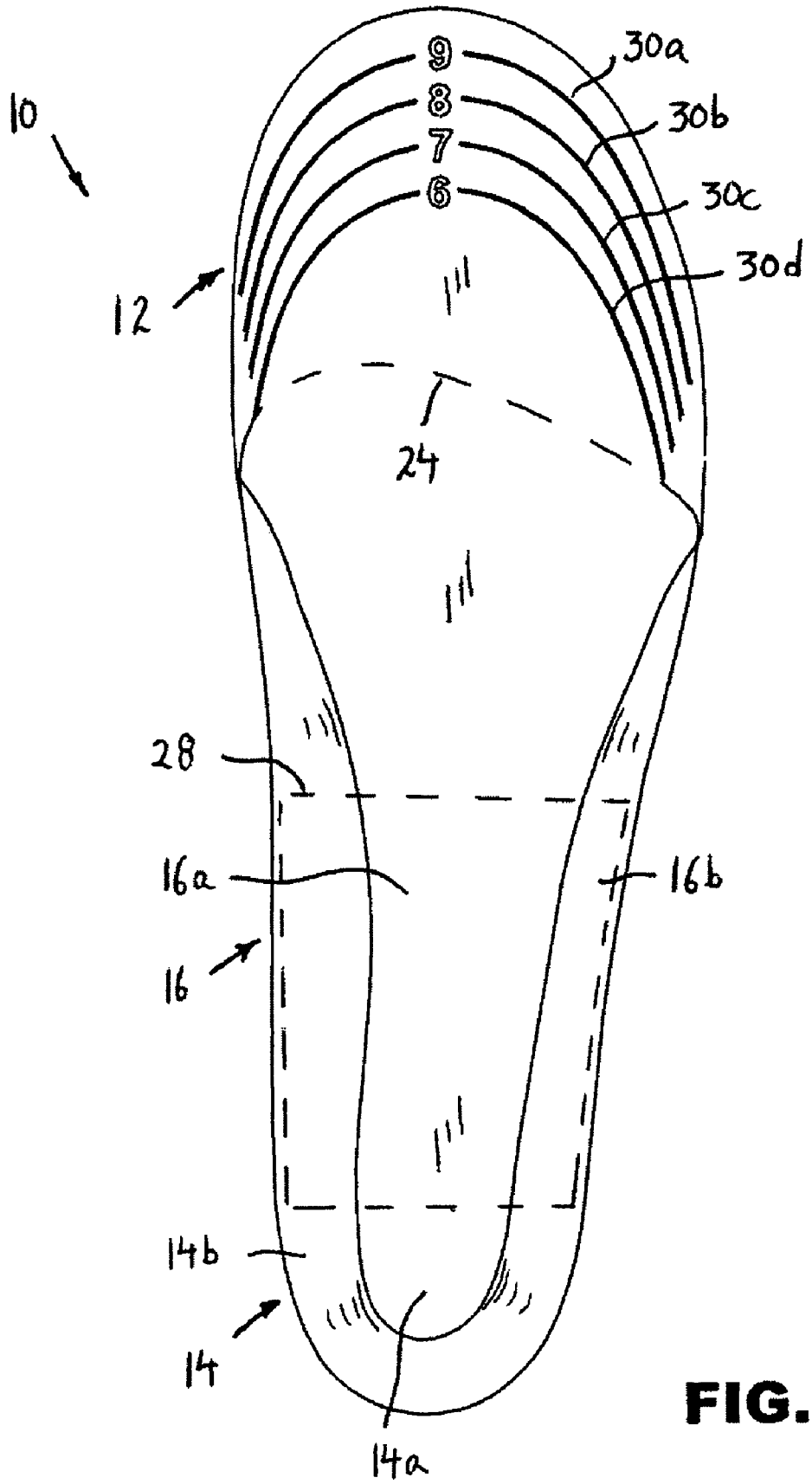
FIG. 3 is a bottom plan view of the left insole.

It will be appreciated that insole 10 is a full length insole, that is, extends along the entire foot. Typically, insole 10 would be sized corresponding to shoe sizes and would be provided in sized pairs. Alternatively, insole 10 may be trimmed to the requirements of the user. In this regard, arcuate pattern trim lines 30*a*-30*d* may be formed on the lower surface of forefoot portion 13 of insole 10, as shown in FIG. 3, and which are representative of various sizes of the human foot. For example, insole 10 may be provided for a woman's shoe size of 10, with first continuous pattern trim line 30*a* being representative of a smaller size insole for a woman's shoe size 9, second continuous pattern trim line 30*b* extending around the periphery of forefoot portion 12 indicative of another size of insole for a man's shoe size 8, and so on. If the user requires a size other than the original large size, the wearer merely trims the insole with a scissors or cutting instrument, using pattern trim lines 30*a*-30*d* to achieve the proper size. The pattern trim lines may be imprinted by conventional printing techniques, silkscreening and the like. As an alternative, pattern trim lines 30*a*-30*d* may be formed as shallow grooves, or be perforated, so that a smaller size insole may be separated by tearing along the appropriate trim lines, which tearing operation is facilitated by the inclusion of perforations. Thus, forefoot portion 12 can be trimmed so that forefoot portion 12 fits within the toe portion of a shoe.

In addition to the forefoot structure, a cup-shaped arrangement is provided for the heel portion 14 and mid-foot portion 16 in order to stabilize the mid-foot and heel, while at the same time, providing overall cushioning and shock absorption of the mid-foot and heel. This is because there are joints in the mid-foot area and heel. If the foot is not held solidly, that is, without side to side movement, there will be much pain due to the excessive joint forces.

Specifically, as shown, heel portion 14 includes a relatively flat central portion 14*a*, and a sloped side wall 14*b*. Generally, when a heel strikes a surface, the fat pad portion of the heel spreads out. The cupped heel portion thereby stabilizes the heel of the person and maintains the heel in heel portion 14, to prevent such spreading out of the fat pad portion of the heel, and to also prevent any side to side movement of the heel in heel portion 14.

The side wall 14*b* of heel portion 14 extends forwardly to the mid-foot as a flange or side wall 16*b* on the lateral and medial sides of mid-foot portion 16, with side wall 16*b* extending to a further extent forwardly at the medial side to correspond to the medial arch portion 16*a* thereat. Side wall 16*b* thereby starts at heel portion 14 and extends at least to a midpoint of insole 10, to provide a foot cradle.

Although the present invention uses the term insole, it will be appreciated that the use of other equivalent or similar terms such as innersole or insert are considered to be synonymous and interchangeable, and thereby covered by the present claimed invention.

It will be appreciated that the present invention is not limited to the specific example given herein. For example, the present invention can be applied to an insole similar to that sold by the assignee herein under the trademarks DR. SCHOLL'S MEMORY FIT WORK INSOLES.

Specifically, as shown in FIGS. 10-14, a left insole 110 according to another embodiment of the present invention is adapted to be placed in an article of footwear, as is well known. A right insole (not shown) is identical to left insole 110 and is a mirror image thereof.

Insole 110 has the shape of a human left foot and therefore includes a curved toe or forefoot portion 112, a heel portion 114, and a mid-foot portion 116 which connects forefoot portion 112 and heel portion 114 together. Heel portion 114 has a greater thickness than forefoot portion 112. For example, heel portion 14 can have a thickness of about 5-8 mm, while toe portion can have a thickness of about 1-6 mm.

Insole 110 is formed by a lower cushioning layer 118, an upper foam layer 120 and a top cover 122 secured to the upper surface of lower cushioning layer 118 at heel portion 114 and mid-foot portion 116, and to the upper surface of upper foam layer 120 along forefoot portion 112, by any suitable means, such as adhesive, RF welding, etc.

Layers 118 and 120 and top cover 112 are preferably made from the same materials as lower layer 18, upper layer 20 and top cover 22, respectively. However, upper layer 120 is secured only lower layer 118 only at forefoot portion 112.

In accordance with this embodiment of the present invention, insole 110 is formed with a structure to alleviate lower back pain and lower extremity pain. Specifically, insole 110 is provided with a shallow recess 132 about 2 mm deep at the lower surface of lower layer 118 in heel portion 114 and mid-foot portion 116. Shallow recess 132 follows the greatest line of force of the foot during a normal stride, that is, in a single limb stance phase. When walking, the foot first impacts at the heel with a large force, for example, up to three times a normal standing force, and then moves toward the forefoot. The heel lifts off of the insole slightly at the position of contact of the mid-foot with the insole and then transfers to the forefoot. At the forefoot, the foot transfers from the position of the fifth metatarsal to the first metatarsal, where push-off occurs at the big toe of the foot. Shallow recess 132 has a shape to follow this line of force, and to cover the high force areas during this stride.

A force line insert 134 having a thickness of about 2 mm and having the same shape as shallow recess 132, is secured within shallow recess 132. Force line insert 134 is made from a softer or more cushioning material than lower layer 118 of insole 110. For example, lower layer 118 of insole 110 can be made from a urethane foam having a Shore "00" durometer hardness in the range of approximately 45-75, more preferably in the range of approximately 55-65, and with a preferred hardness of approximately 60, while force line insert 134 can be made from a softer urethane foam having a Shore "00" durometer hardness in the range of approximately 35-65, more preferably in the range of approximately 45-55, and with a preferred hardness of approximately 50. A preferred material for force line insert 134 is the material sold by Rogers Corporation of Rogers, Conn. under the trademark "PORON". Preferably, force line insert 134 is formed first, and then placed in a mold, where the remainder of lower layer 118 of insole 110 is molded thereon, and thereby bonded to the PORON material of force line insert 134 during the molding operation.

Force line insert 134 can have a constant thickness throughout, or preferably, has a plurality of shallow recesses 134*a* in the lower surface thereof, which form thin walls 134*b* with lower ends that are flush with the lower surface of lower layer 118.

Thus, the force line shape of insert 134 provides a softer material along the center of pressure of the gait line. As a result, force line insert 134 provides cushioning and shock absorption along the stride.

As shown, force line insert 134 includes a heel insert portion 134*c* of a width intended to accommodate the heel during the heel strike and provide cushioning thereof. From heel insert portion 134*c*, insert 134 tapers in width to a mid insert portion 134*d* at mid-foot portion 116. The reason for the taper is that the cushioning material of insert 134 is not needed as much at this position, since there is more surface area of the foot in contact with the upper surface of insole 110 to spread out the forces more evenly, and because the foot is guided toward medial arch portion 126 of mid-foot portion 116 which absorbs much of the forces.

Thus, with the initial heel strike, heel insert portion 134*a* functions to provide greater cushioning and shock absorbing at the heel. As the foot moves forwardly, there is still a line of contact at the mid-foot, but medial arch portion 126 also absorbs much of the force, so as to provide an evening out of the force at the mid-foot. As a result, the width of mid insert portion 134*d* can be reduced. Thereafter, the foot transfers to the forefoot, and particularly, from the fifth metatarsal to the first metatarsal, where push-off occurs at the big toe of the foot. However, in this area, the thickness of lower layer 118 is reduced in the same manner as lower layer 118 in the embodiment of FIGS. 1-9. Therefore, as with the first described embodiment, the combination of layers 118 and 120 results in providing a perfect contact image of the bottom of the person's foot at forefoot portion 112. In other words, forefoot portion 112, and particularly, layer 120 thereat, sculpts to the bottom of the person's foot, perceptually making the person feel better by providing a maximum proprioception response and a perception of maximum comfort to the wearer.

As with the first embodiment, heel portion 114 is preferably a cupped heel portion, having a relatively flat central portion 114*a*, and a sloped side wall 114*b* that extends around the sides and rear of central portion 114*a*.

Unlike the first embodiment, the lower surface of mid-foot portion 116 is flat, and medial arch portion 126 is built up by providing spaced apart, transverse oriented grooves or recesses 136 therein, which define transverse flex members 138 therebetween which effectively function as springs. The advantage of using flex members 138 is that the bulk of arch portion 126 is not needed and thereby greatly reduced. It therefore becomes easier and better to use flex members 138 with shoes, since they can be used in shoes with or without a built in arch support.

Flex members 138 function in concert with force line insert 134 to provide even cushioning support and shock absorption over the entire mid-foot area during mid-stance phase. Because of flex members 138, the width of mid insole portion 134*b* can be reduced. The use of flex members 138 is well known in insoles.

Thus, with the initial heel strike, heel insert portion 134*a* functions to provide greater cushioning and shock absorbing at the heel. As the foot moves forwardly, there is still a line of contact at the mid-foot, but medial arch portion 126 also absorbs much of the force, so as to provide an evening out of the force at the mid-foot. As a result, the width of mid insert portion 134*b* can be reduced. Thereafter, the foot transfers to the forefoot, and particularly, from the fifth metatarsal to the first metatarsal, where push-off occurs at the big toe of the foot. However, in this area, the thickness of lower layer 118 is reduced in the same manner as lower layer 18 in the embodiment of FIGS. 1-9. Therefore, as with the first described embodiment, upper layer 120 provides cushioning and also imparts a three-dimensional shape of the insole. The very soft and cushioning upper foam layer 120 is thereby capable of conforming to the shape of the plantar surface of a person's foot during gaiting or by stepping thereon. The foam material also has a unique rebound rate such that the imprint of the plantar surface can be clearly seen during the rebound phase upon recovery from compression. Therefore, the present invention provides an insole that is capable of customizing to the individual anatomical plantar features during gaiting by virtue of the soft and the unique rebound behaviors of upper layer 120. However, unlike insole 10, insole 110 provides this feature only at forefoot portion 112.

The present invention is also applicable to insoles other than full length insoles, such as heel cups, arch supports and ball of foot cushions.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A removable insole for insertion into footwear, comprising:

a) at least one of:
  i) a forefoot portion,
  ii) a heel portion, and
  iii) an arch portion; and b) at least one of said forefoot portion, heel portion and arch portion being formed by:
  i) a lower layer of a resilient material which provides a cushioning function, and
  ii) an upper layer positioned and secured on top of said lower layer and formed of a material having:
    A) a Shore "000" hardness of less than about 45, and
    B) a tear strength greater than about 6.3 lb/in.

2. A removable insole according to claim 1, wherein said insole is a full length insole formed from said forefoot portion, heel portion and arch portion connecting together said forefoot portion and said heel portion.

3. A removable insole according to claim 2, wherein said upper layer extends along an entire length of said insole in said forefoot portion, heel portion and arch portion.

4. A removable insole according to claim 2, wherein said upper layer extends substantially only along said forefoot portion.

5. A removable insole according to claim 1, wherein said lower layer and upper layer have the same dimensions and shapes, and the upper layer is superposed on said lower layer.

6. A removable insole according to claim 1, wherein said lower layer has a greater thickness than said upper layer at the heel portion.

7. A removable insole according to claim 1, wherein said upper layer has a greater thickness than said lower layer at the forefoot portion.

8. A removable insole according to claim 1, further comprising a top cover secured to an upper surface of said upper layer.

9. A removable insole according to claim 1, wherein said heel portion is cupped so as to be formed by a relatively flat central portion and a sloped side wall.

10. A removable insole according to claim 9, wherein said sloped side wall extends around a periphery of said heel portion and forwardly to at least said arch portion of the insole.

11. A removable insole according to claim 1, wherein said upper and lower layers are both formed from polyurethane materials.

12. A removable insole according to claim 1, wherein said upper layer has a Shore A000" hardness of about 30.

13. A removable insole according to claim 1, wherein said insole includes at least said arch portion, and further comprising a rigidifying material secured between said upper and lower layers for increasing rigidity of said lower layer during manufacturing of the insole in order to retain a lower surface of said arch portion in an arched configuration.

14. A removable insole according to claim 13, wherein said rigidifying material includes a non-woven fabric.

15. A removable insole according to claim 1, wherein said insole includes at least an arch portion, said arch portion including a lower surface and an upper surface, and said lower surface being raised up to conform to an arch of a person's foot.

16. Footwear comprising:

a) an outer sole;

b) an inner sole connected to said outer sole, said inner sole including:

i) a forefoot portion extending at least to metatarsals of a foot, ii) a heel portion, and iii) a mid-foot portion connecting together said forefoot portion and said heel portion, said mid-foot portion including a medial arch portion;

c) at least one of said forefoot portion, heel portion and mid-foot portion being formed by:

i) a lower layer of a resilient material which provides a cushioning function, and ii) an upper layer positioned and secured on top of said lower layer and formed of a material having:

A) a Shore "000" hardness of less than about 45, and

B) a tear strength greater than about 6.3 lb/in; and d) an upper connected to at least one of said outer sole and said inner sole.

17. Footwear according to claim 16, wherein said lower layer and upper layer have the same dimensions and shapes, and the upper layer is superposed on said lower layer.

18. Footwear according to claim 16, wherein said lower layer has a greater thickness than said upper layer at the heel portion.

19. Footwear according to claim 16, wherein said upper layer has a greater thickness than said lower layer at the forefoot portion.

20. Footwear according to claim 16, further comprising a top cover secured to an upper surface of said upper layer.

21. Footwear according to claim 16, wherein said heel portion is cupped so as to be formed by a relatively flat central portion and a sloped side wall.

22. Footwear according to claim 21, wherein said sloped side wall extends around a periphery of said heel portion and forwardly to at least said arch portion of the insole.

23. Footwear according to claim 16, wherein said upper and lower layers are both formed from polyurethane materials.

24. Footwear according to claim 16, wherein said upper layer has a Shore A000" hardness of about 30.

* * * * *